United States Patent [19]

Hess et al.

[11] 4,321,439

[45] Mar. 23, 1982

[54] ELECTRICAL CONTACT CONSTRUCTION FOR AIR-BLAST CIRCUIT BREAKERS

[75] Inventors: Rüdiger Hess; Heiner Marin, both of Berlin, Fed. Rep. of Germany

[73] Assignee: Siemens Aktiengesellschaft, Munich, Fed. Rep. of Germany

[21] Appl. No.: 90,122

[22] Filed: Nov. 1, 1979

[30] Foreign Application Priority Data

Nov. 2, 1978 [DE] Fed. Rep. of Germany ..... 2847808

[51] Int. Cl.[3] ..... H01H 33/70

[52] U.S. Cl. ..... 200/148 A; 200/148 R

[58] Field of Search ..... 200/148 A, 148 R

[56] References Cited

U.S. PATENT DOCUMENTS 4,160,140 7/1979 Rolff ..... 200/148 R

FOREIGN PATENT DOCUMENTS 2336684 1/1975 Fed. Rep. of Germany ... 200/148 A

*Primary Examiner*—Robert S. Macon

*Attorney, Agent, or Firm*—Kenyon & Kenyon

[57] ABSTRACT

An electrical contact construction for air-blast circuit breakers, particularly blast-piston or "puffer" type breakers, which subject the arc drawn during current interruption to a compressed-gas blast as well as a magnetic-force effect which lengthens the arc. To increase the interruption capacity of such breakers, and particularly to improve arc behavior during the interruption process, a tubular member is disposed within the interior spaces of the tubular contacts of such a breaker in which the switching gases flow. The member has an inner surface which is conically shaped and is matched to the contour of openings provided in nozzle members disposed at the end faces of the tubular contacts to improve gas flow.

4 Claims, 1 Drawing Figure

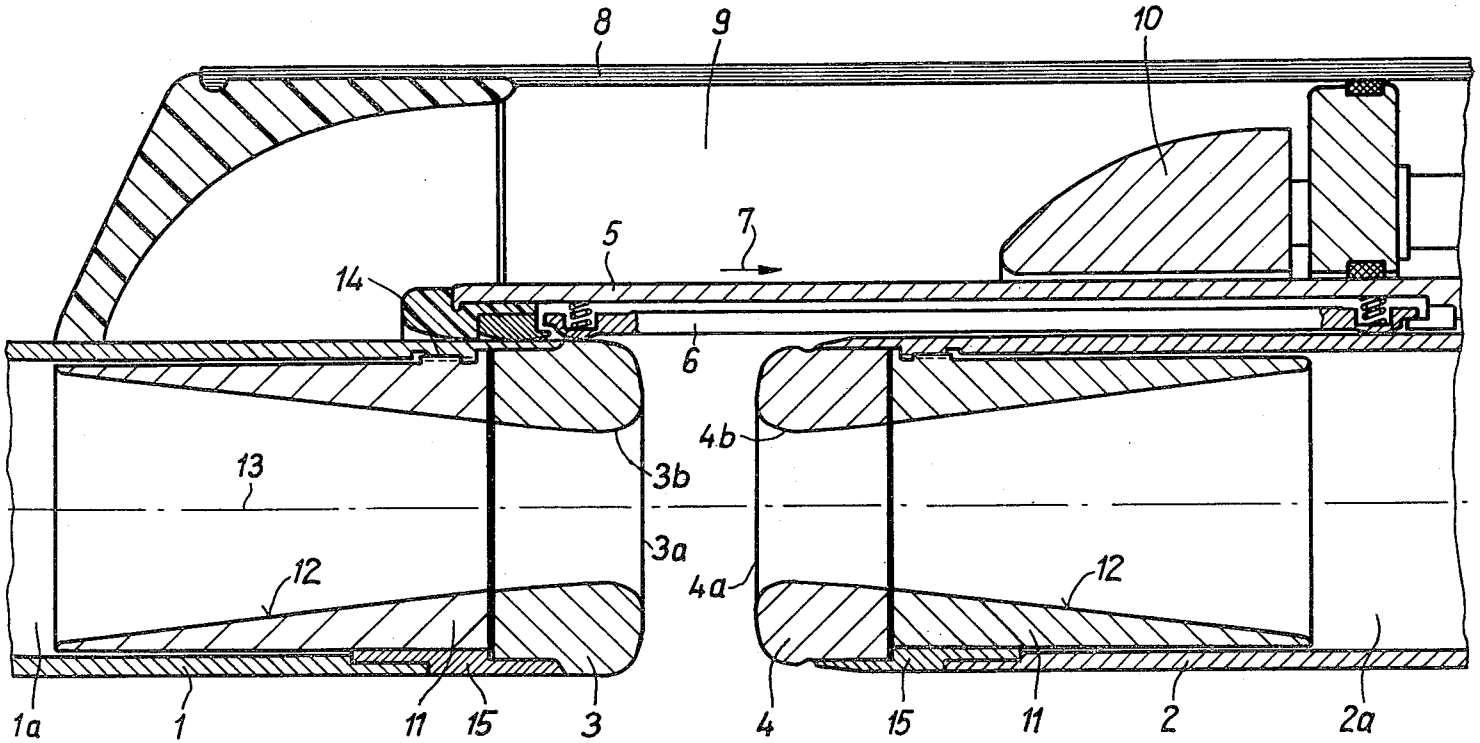
10
9
8
7
5
6
14
4b
3b
4a
3a
13
12
12
2a
2
11
15
4
3
15
11
1
1a

ELECTRICAL CONTACT CONSTRUCTION FOR AIR-BLAST CIRCUIT BREAKERS

BACKGROUND OF THE INVENTION

1. Field of the Invention

The present invention relates to an improved electrical contact construction for air-blast circuit breakers including a tubular contact and a contact axially associated therewith (also tubular in shape) between which, upon interruption under load, an arc is drawn which is blasted by a stream of compressed gas, and in which each tubular contact has a nozzle at its end face in which a tubular member fabricated of ferromagnetic material is disposed in spaced-apart relationship to the contact.

2. Description of the Prior Art

Contact arrangements of the foregoing type are known in the art. See German Offenlegungsschrift Nos. 27 06 470 and 26 24 595. In such arrangements, the arc produced upon interrupting a current flow through the breaker is driven into the interior of the tubular contacts by the compressed gas blast. The bases of the arc travel towards and reach the tubular members, which are designed as hollow cylinders of ferromagnetic material, inside the contacts, and at that point the magnetic field induced in the tubes contributes to driving the bases of the arc away from the nozzles of the contacts. As a result, the arc bases travel along the inside walls of the tubular members in a direction away from the nozzle members. In this manner, the arc is lengthened and more reliably quenched by the compressed-gas stream blast. It has been found in practice that currents of only up to 80 kA can be switched reliably using such a contact arrangement.

SUMMARY OF THE INVENTION

It is an object of the present invention to provide an improved contact construction for air-blast circuit breakers in which the switching capacity of the breakers is increased by increasing the breaker interruption currents, particularly where interruption is due to a distant short circuit.

These and other objects of the invention are achieved in an air-blast circuit breaker including axially disposed tubular electrical contacts between which an arc is conducted during interruption of a current flow through the breaker. The arc is blasted by a stream of compressed gas and the tubular contacts have nozzle members disposed on opposing end faces thereof. The nozzle members each include a nozzle opening having a contour which is flared outwardly from the end faces thereof. A tubular member fabricated of ferromagnetic material is disposed concentrically within each of the tubular contacts and is spaced apart from the inner surface thereof. The improvement of the invention comprises a tubular member including a radially inner surface having a conically-shaped contour which is matched to the contour of the nozzle opening of each of the nozzle members so that the contour of the nozzle opening is continued by the inner surface contour of the tubular member.

By means of the improvement of the invention, both arcing behavior and the control of the quenching gas flow are improved so that the current interruption capacity of the breaker is increased. In a particularly advantageous embodiment of the invention, the position of the tubular member with respect to the tubular contacts is fixed by means of a screw connection which considerably simplifies the manufacturing process. The electrical connection necessary for guiding the arc during the interruption process is achieved by electrically connecting the tubular members with the nozzle members by means of the tubular contacts. This eliminates the need to directly mechanically connect the nozzle members, which usually are fabricated of graphite, and the tubular members, which are preferably fabricated of magnetic steel, whose coefficients of expansion become effectively different under the arc stress. In an arrangement in which two tubular contacts are disposed on the same axis, each of which has a tubular member disposed within its interior, both tubular members preferably are of identical shape.

These and other novel features and advantages of the invention will be described in greater detail in the following detailed description.

BRIEF DESCRIPTION OF THE DRAWING

The drawing is a cross-sectional, longitudinal view of an improved electrical contact construction for air-blast circuit breakers constructed in accordance with the present invention.

DETAILED DESCRIPTION

Referring now to the drawing, there is shown an improved electrical contact construction for air-blast circuit breakers designed as a blasting-piston, i.e., so-called "puffer" type switch. The contact arrangement comprises a pair of fixed tubular contacts 1 and 2 which are disposed on a common axis and have nozzle members 3 and 4 fabricated of graphite disposed on their opposing end faces. Contacts 1 and 2 are bridged, in the "on" position of the circuit breaker shown in the drawing, by a tubular shorting or bridging contact 5 which surrounds several spring-loaded contact fingers 6 distributed over the circumference of contacts 1 and 2 and in the position shown is in engagement with contact 1. During opening of the breaker, contact 5 moves in the direction of the arrow 7 and a blasting cylinder 8 surrounding contacts 1 and 2 is moved simultaneously in the same direction. The blasting cylinder compresses a gas contained in an interior space 9 of the cylinder as it moves over and toward an essentially fixed piston 10.

When contact fingers 6 are disengaged from contact 1, an arc is drawn which is commutated from contact 5 to nozzle member 4. The arc bridging nozzle members 3 and 4 is then driven into interior spaces 1*a* and 2*a* within contacts 1 and 2 by the compressed-gas blast produced by movement of the blasting cylinder 8. Tubular members 11, which are fabricated of ferromagnetic material, preferably steel, are mounted in spaces 1*a* and 2*a* of contacts 1 and 2 adjacent nozzle members 3 and 4 and are spaced apart from the inner surfaces or walls of contacts 1 and 2.

The radially inner surface 12 of each tubular member 11 has a conical shape, i.e., defines an opening or passage having a conical shape, and is matched to the contour of nozzle members 3 and 4 so that the inner conical contours of nozzle openings 3*b* and 4*b*, which are flared out from the end faces 3*a* and 4*a* of nozzle members 3 and 4, are continued by the inner surface contours of tubular members 11.

In the embodiment of the electrical contact construction shown above the dashed center line 13 in the drawing, each tubular member 11 is fixed in position by means of a screw connection 14 with respect to tubular contacts 1 and 2. Tubular members 11 and nozzle members 3 and 4 are electrically connected to each other by means of contacts 1 and 2, respectively. In the embodiment of the contact construction shown below center line 13, nozzle members 3 and 4 and tubular members 11 are mounted on an annular-shaped electrically conductive intermediate member 15 which is screwed to contacts 1 and 2. In both embodiments of the invention, tubular members 11 have identical shapes.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawing are, accordingly, to be regarded in an illustrative rather than in a restrictive sense.

What is claimed is:

1. In an air-blast circuit breaker including axially disposed tubular electrical contacts between which an arc is conducted during interruption of a current flow through the breaker, said arc being blasted by a stream of compressed gas and said tubular contacts having nozzle members disposed on opposing end faces thereof, said nozzle members each including a nozzle opening having a contour which is flared outwardly from the end faces thereof, said breaker further including a tubular member fabricated of ferromagnetic material disposed concentrically within each of said contacts and spaced apart from the inner surface thereof, the improvement comprising said tubular member including a radially inner surface having a conically-shaped contour which is matched to said contour of said nozzle opening of each of said nozzle members so that said contour of said nozzle opening is continued by said inner surface contour of said tubular member.

2. The improvement recited in claim 1, wherein said tubular member is secured to each of said tubular contacts by means of a screw connection.

3. The improvement recited in claims 1 or 2, wherein each said tubular member is electrically connected to said nozzle members by said tubular contacts.

4. The improvement recited in claims 1, 2 or 3, wherein said tubular contacts are disposed in axially opposing relationship and each have a tubular member of identical shape disposed therewithin.

* * * * *